United States Patent [19]

Greenspan et al.

[11] Patent Number: 4,911,060

[45] Date of Patent: Mar. 27, 1990

[54] REDUCED WEIGHT GUN TUBE

[75] Inventors: Jacob Greenspan, Newton, Mass.; Richard G. Hasenbein, Albany; Edward J. Hyland, Clifton Park, both of N.Y.

[73] Assignee: The United States of America as represented by the Secretary of the Army, Washington, D.C.

[21] Appl. No.: 325,606

[22] Filed: Mar. 20, 1989

[51] Int. Cl.[4] ..... F41F 17/04

[52] U.S. Cl. ..... 89/14.05; 42/76.02; 89/16

[58] Field of Search ..... 89/16, 14.05, 14.1; 42/76.01, 76.02

[56] References Cited

U.S. PATENT DOCUMENTS

| | | | |
|---|---|---|---|
| 186,308 | 1/1877 | Crispin | 89/16 |
| 269,100 | 12/1882 | Palliser | 89/16 |
| 2,137,259 | 11/1938 | Boak | 89/16 |
| 3,004,361 | 10/1961 | Hammer | 89/16 |
| 3,991,928 | 11/1976 | Friedrich et al. | 228/190 |
| 4,641,450 | 2/1987 | Moll et al. | 89/16 |
| 4,722,825 | 2/1988 | Goldstein | 89/16 |
| 4,756,677 | 7/1988 | Hribernik et al. | 89/16 |

FOREIGN PATENT DOCUMENTS

| | | | |
|---|---|---|---|
| 282209 | 9/1934 | Italy | 89/14.05 |

*Primary Examiner*—Charles T. Jordan
*Assistant Examiner*—Stephen Johnson
*Attorney, Agent, or Firm*—Richard J. Donahue

[57] ABSTRACT

A gun tube having an outer sleeve of reduced weight from that of the base and having improved characteristics in firing accuracy. A method of fabrication pertaining to a selected titanium alloy sleeve in combination with a steel base is also disclosed.

1 Claim, 2 Drawing Sheets

REDUCED WEIGHT GUN TUBE

The invention described herein may be manufactred used and licensed by or for the Government for Governmental purposes without the payment to us of any royalty thereon.

BACKGROUND OF THE INVENTION

1. Field of The Invention

The invention relates to ordnance devices and more particularly to the structure and method of manufacture of gun tubes or cannon barrels.

2. Description of the Prior Art

Weight reduction of armaments for facilitating transport and field manipulation is a desirable goal in the ordnance art. The present invention reduces weight in a gun tube by replacing a substantial portion of a conventional steel base with a sleeve of lighter material, for example, a titanium alloy.

As known to the inventor, neither the device nor the method of manufacture disclosed herein exist in the prior art.

SUMMARY OF THE INVENTION

The invention may be summarized as a gun tube or barrel of reduced weight achieved by replacing the outer portion of, for example, a conventional steel base with a sleeve of lighter material, as for further example, one composed of titanium alloy.

In designing a gun barrel it is necessary to provide sufficient mass and thickness to meet ballistic design requirements, to prevent the barrel from initial rupturing, and further to withstand the heat and mechanical stress of repeated use. It is also desirable to utilize a structure which, to a certain degree, will withstand external assault, for instance, small arms fire.

For these reasons, weight reduction cannot be achieved by the simple elimination of material from the barrel, but must be accomplished by the substitution of a material of lesser weight but closely related mechanical characteristics. Additionally, due to the size, fabrication of the finished barrel requires in the instant case the matching of a selected material and series of fabrication steps which is in and of itself unique. Specifically, a particular titanium alloy, Ti-3Al-8V-6Cr-4Mo-4Zr ("Beta C" alloy) has been found to be especially suitable for this purpose due to its mechanical properties and an amenability to air cooling during heat treatment. Such air cooling is required by the inherently large structures which are the subject of this invention.

Accordingly, the invention consists of weight reduction in a gun tube by the substitution o a lighter outer sleeve for a portion of the heavier base, the use of a specific titanium alloy particularly suited for this purpose, and the unique methods by which such sleeve and final assembly are fabricated.

The advantages and features of the invention will be more fully understood from the description of the preferred embodiment and drawings which follow.

DESCRIPTION OF THE PREFERRED EMBODIMENT

Figure 1:
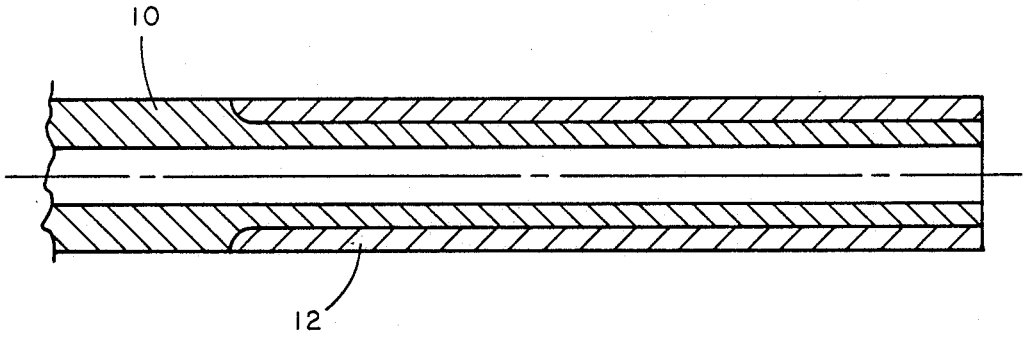
FIG. 1 is a cross-sectional schematic drawing of the preferred embodiment of the invention.

Referring first to FIG. 1, there is schematically illustrated a gun tube or cannon barrel comprising the preferred embodiment of the invention. Base 10 is preferably constructed of steel and sleeve 12 of a lighter material for example a titanium alloy.

The material selected for the lighter weight sleeve is required to possess mechanical characteristics which closely match that of the base and must also be capable of being fabricated by methods suited for such large structures.

The utilization of titanium alloy as a sleeve material is based not only on its light weight, but also its potential to meet suitable mechanical characteristics. The processing approach taken wherein to attain the titanium alloy sleeve is comprised of a melt and cast, plastic work, heat treat sequence of operations. More specifically these are: (1) synthesize a primary ingot of the titanium alloy by a double vacuum arc melting method; (2) hot forge the ingot to configuration and dimensions of an extrusion billet, using a series of press forging reductions; (3) hot extrude to tubular form; and (4) precision heat treat to attain final mechanical characteristics.

The principal constraints and unknown factors that arise during the course of this processing relate primarily to the size factors encountered, since titanium alloy components of the present mass and configuration, and conditioned to the present mechanical properties have hereto before not been achieved. Basic to the latter are the microstructural factors, namely crystallographic refinement and compositional homogeneity. It is well known that large crystallites or "grains" of ingot materials, in general, are reduced in size by hot plastic work and further by recrystallization at elevated temperature. In addition, the compositional homogeneity is improved by the accelerated interatomic diffusion that occurs simultaneously with elevated temperature plastic work. Consequently, through a particular series of steps detailed below, general steps, (1), (2) and (3) maximize the preceding and result in a tube formed from a primary ingot in which the cross sectional area is reduced by a substantial percentage, for example in the area of ninety percent.

Figure 2:
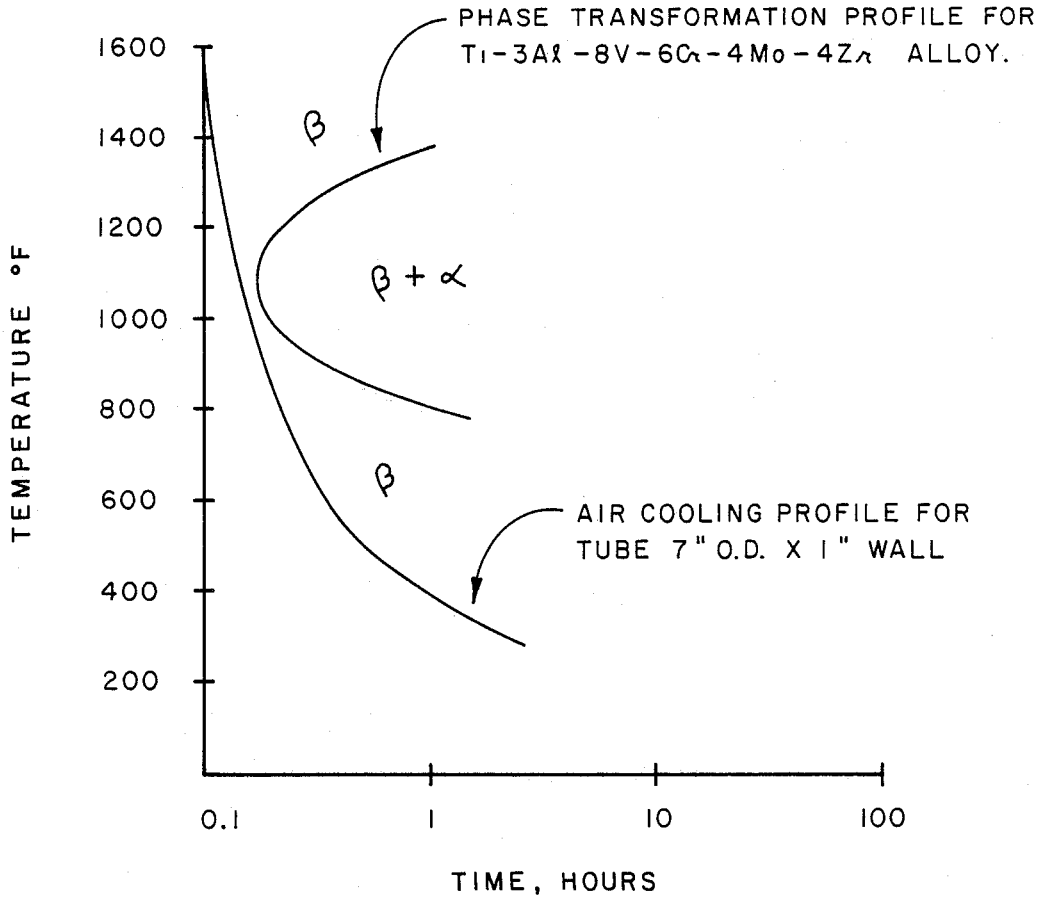
FIG. 2 is a graphic illustration of the essential phase transformation characteristics of one alloy, Ti-3Al-8V-6Cr- 4Mo-4Zr (Beta C alloy), employed in the preferred embodiment of the invention.
Figure 3:
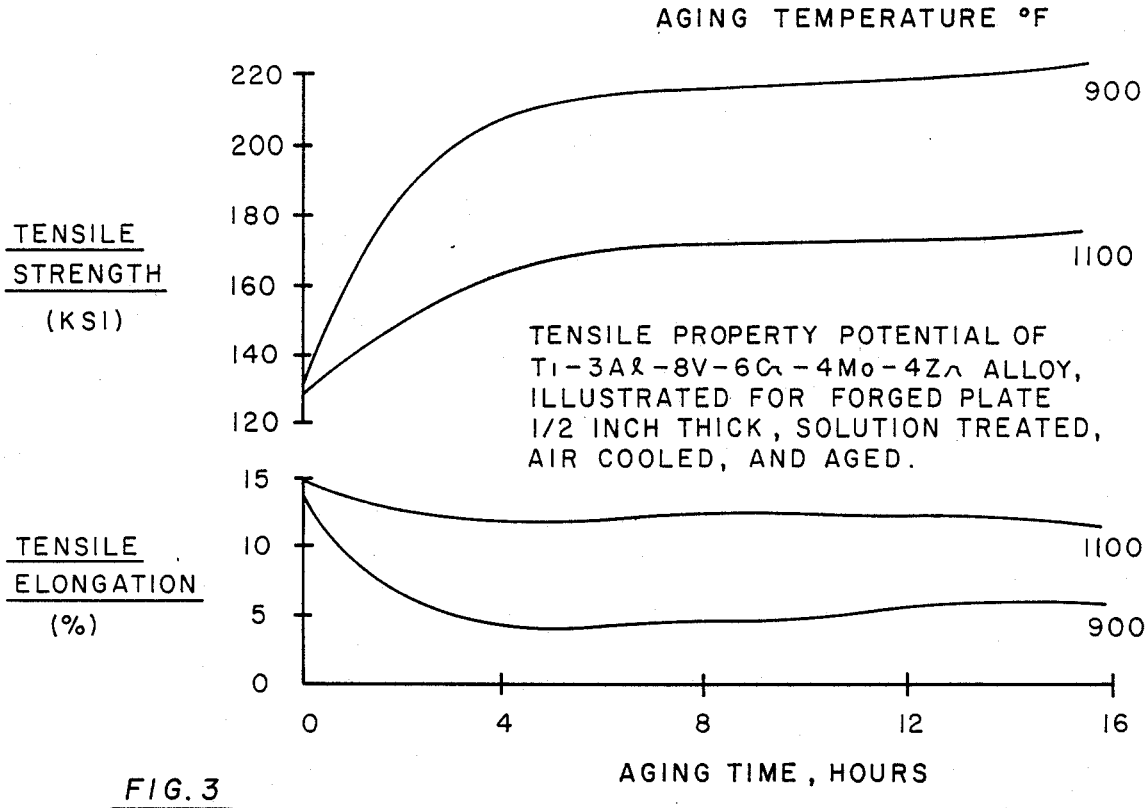
FIG. 3 is a graphic illustration of the mechanical property potential of such alloy.
Figure 4:
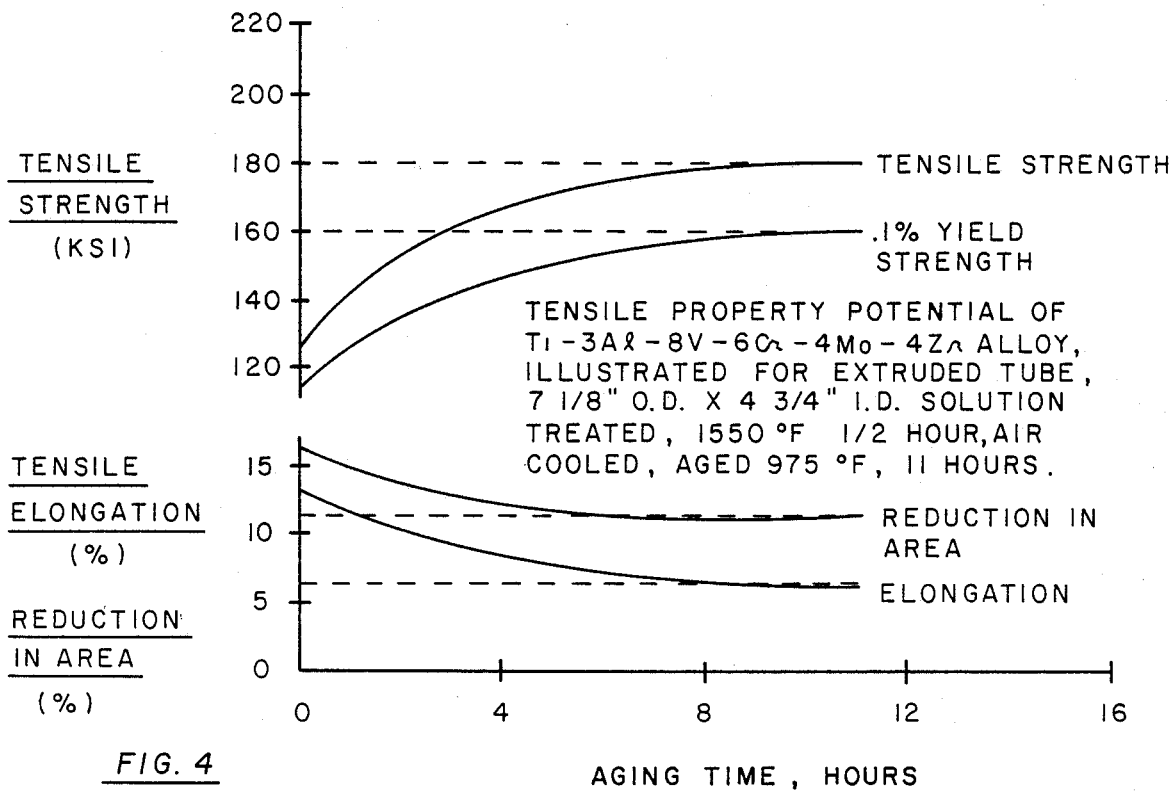
FIG. 4 is a graphic illustration of the essential properties achieved in the preferred embodiment of this invention.

The methodology of the heat treat process of general step (4) is greatly determined by the size of the finished product. First, the commonly known "solutionize and age harden" approach is employed in general to condition the mechanical characteristics of the titanium alloy. Thus (a) the alloy ingredients are rendered into solid solution at certain elevated temperatures, (b) they are retained in solid solution, in metastable condition, on cooling to room temperature, and (c) they are precipitated at certain elevated temperature to comprise the final age hardened condition. For large metallurgical mass, as that of the present, step (b) requires special attention because of the magnitude of the heat removal requirement. Thus, if fast cooling, or quenching is necessary, as is the case with most titanium alloys, the heat removal rates required cannot be achieved in practice, and therefore the heat treat process is rendered inadequate for the needs of the present sleeve component. From this standpoint therefore it is essential that step (b) be accomplished by relatively slow cooling, and most conveniently b normal air cooling of the metallurgical mass on removal from the furnace in which the solutionizing process of step (a) is accomplished. Therefore it is essential that the alloy employed be characterized with phase transformation kinetic able to accommodate such a cooling. Referring to FIG. 2, a time temperature transformation diagram illustrates the parameters involved in selecting such an alloy particularly suited for use in the invention i.e.,Ti-3Al-8V-6Cr-4Mo-4Zr (Beta C alloy). Here the single phase beta region comprises the solutionized condition. In this light, a time temperature profile for normal air cooling of the tube is seen to be contained in this single phase beta region; thus the solutionized condition is retained as desired. Therefore, the alloy selection, by methods of this invention, is based on the behavior shown in FIG. 2 and further on the age hardening potential illustrated in FIG. 3. This is attained by reheating to the two phase alpha beta region of FIG. 2, where a dispersion of alpha particles is precipitated in a matrix of the beta phase. However, by the methods of this invention, the precise age hardening parameters for the present tube are determined by trial and error since such tube has not heretofore been so processed. The parameters thus determined are indicated in FIG. 4, and described further in the following.

After the fabrication of the sleeve as generally described above, the inside diameter of the sleeve and the outside diameter of the steel base are precision machined for an 0.005 inch interference fit, as is required to shrink fit the two together. This is accomplished as follows. The sleeve and base are held in tandem vertically and co-axially, muzzle end downward, with the base suspended above, and the sleeve anchored below. The sleeve is then induction heated to approximately 800 degrees F. (430 degrees C. ), where the diametric thermal expansion accommodates a slip fit with the steel base that remains at ambient room temperature. The steel base is then promptly lowered into the bore of the titanium sleeve. In order to obtain the ensuing thermal condition as symmetric as possible, water is sprayed radially on the outside diameter of the titanium sleeve, beginning at the top, and then uniformly in axial direction by controlled motion of the water spray in that direction. With the shrink fit thus accomplished, the steel bore is then machined to final diameter.

The following additional operations are now performed, (1) swaging or autofrettaee of the steel bore, and (2) chromium plating of the steel bore, as done conventionally for all steel gun tubes. The swaging operation consists of forcing an oversize mandrel through the steel bore to create residual stresses. In the present case, this swaging causes the steel base to flow plastically, while the titanium sleeve remains elastic, due to the differences in the elastic moduli of the two materials, and the degree of interference between the mandrel and the tube diameters. This not only improves the shrink fit, but also enhances those residual stresses that are favorable to the operational life cycle of the gun tube.

The assembly is then reheated to 700 degrees F. (350 degrees C.) to properly temper the steel, while not affecting the titanium sleeve significantly. The assembly is then machined to whatever the final dimensions are required for integration into a functional armament design.

As a particular example, a gun tube has been manufactured by the above methodology in accordance with the specific steps listed herein.

1. Double vacuum arc melt a 30 inch diameter primary ingot of Ti-3Al-8V-6Cr-4Mo-4Zr alloy (Beta C Alloy).
2. Forge to 18 inch diagonal square at 1975 degrees F. and air cool.
3. Remove surface flaws.
4. Forge to 14½ inch diagonal square at 1975 degrees F. and air cool.
5. Forge to 14½ inch diagonal octagon at 1975 degrees F. and air cool.
6. Forge to 14 inch diameter round at 1975 degrees F. and air cool.
7. Cut into 14 inch diameter by 6 foot long sections to form a billet.
8. Trepan a 5 inch diameter hole in the billet.

9Extrude the billet at 1850 degrees F. to a tube, 7⅛ inch OD by 4¾ inch ID by 30 feet long and air cool. Cut into 10 feet long sections.

10. Solution treat, at 1550 degrees F. for 30 minutes and air cool.
11. Age harden, at 975 degrees F., for eleven hours and air cool.
12. Machine to final configuration.
13. Shrink fit to steel base.
14. Autofrettage and temper.
15. Finish machine.

A prototype cannon tube was fabricated in accordance with the detailed method described above and then subjected to a field firing test program. The prototype exhibited the following characteristics during the 95 round test:

Mechanically, the cannon delivered projectiles on target with satisfactory dispersion characteristics.

Structurally, the tube was within acceptable limits. The bore size was increased by 1–2 mils in some areas, but this would not be unusual for any cannon. Chrome losses at the bore were also within acceptable limits.

Thermally, the tube achieved a maximum temperature at the outside diameter of 485 degrees F. during firing with no apparent deleterious effects. It was noted that, at elevated temperatures, the steel base expands axially more than the titanium sleeve due to the difference in thermal expansion coefficients. This caused the steel base to protrude slightly beyond the jacket by varying amounts during the test, but no harmful effects were noted.

During a rapid firing sequence, the tube remained on target remarkably well particularly since it had not been fitted with a thermal shroud. Rapid firing often sets up thermal gradients in steel cannon tubes which force the muzzle downward, thus making successive shots fall lower on the target. Without a thermal shroud to control the extent of motion, the projectiles soon begin to miss the target, impacting the ground in front of it. With this prototype tube, all shots stayed on the target, and successive shots moved slightly upward and to the right during firing.

Dynamically, the tube exceeded all expectations. When projectile velocities are low, all tubes dilate radially by an amount which can then be calculated from statics equations. At higher projectile velocities, dynamic amplifications of this static dilation can be significant, in some cases, on the order of 4 to 5. For this prototype, amplifications were unexpectedly low, only about 2. Dynamic finite element analysis indicated the reason is related to the ability of the steel base and titanium sleeve to move axially and radially with respect to each other. These results imply that use of the invention may provide a further benefit, i.e., a means by which to attenuate dynamic strain amplifications.

In addition to the above firing prototype, four jacketed cylinders were fabricated by the same techniques described in the preceding. The length of the cylinders however was foreshortened by three feet to allow hydraulic pressurization to be accomplished by the laboratory.

In the first test, internal pressure was increased until the cylinder burst. The "Strain vs. Pressure" and "Burst Pressure" measurements compared very favorably with analytical predictions, indicating that the design precepts were well understood.

In the second and third tests, the cylinders were subjected to multiple high-pressure pulses in order to assess fatigue modes of failure. The second cylinder was tested as fabricated and the third cylinder alone was intentionally notched at the inner diameter to initiate an early crack. In both cases the fatigue crack initiated at the inside diameter and grew outward to the steel titanium interface. At that point, it was necessary to stop both tests because of leaking hydraulic fluid. This leak-before-break mode of failure is considered very favorable, in terms of a fail-safe characteristic.

In the fourth test, the cylinder was shot at close range with a 0.30 caliber armor piercing projectile. The projectile completely penetrated the titanium jacket, stopping at the steel base. The cylinder thus damaged was subjected to a hydraulic fatigue test and withstood 388 pressure cycles before failing by axial rupture of the jacket. The conclusion is that the tube of the invention can still be safely fired for a significant number of rounds, even after sustaining severe ballistic damage.

The novel device and method having been fully described by the above, the scope of the invention is hereby defined by the following claims:

What is claimed is:

1. A gun tube comprising in combination:

a tubular base formed of steel and having a forward portion said tubular base having an inner diameter in excess of 4.75 inches;

a titanium alloy sleeve disposed over said forward portion of said tubular base;

said titanium alloy sleeve having a tensile strength at least equal to that of said tubular steel base and being comprised of Ti-3Al-8V-6Cr-4Mo-4Zr (Beta C Alloy) material;

said titanium alloy sleeve being shrink fitted to said tubular steel base;

said titanium alloy sleeve and said tubular steel base providing a composite gun tube of lesser weight but of at least equal strength when compared to an all-steel gun tube of equal dimensions.

* * * * *